US005257845A

United States Patent [19]

McConnell

[11] Patent Number: 5,257,845

[45] Date of Patent: Nov. 2, 1993

[54] DETACHABLE HAND GRIP FOR CARRYING BAGS AND THE LIKE

[76] Inventor: Michael J. McConnell, 3740 Martin Farm Rd., Suwanee, Ga. 30174

[21] Appl. No.: 968,662

[22] Filed: Oct. 30, 1992

[51] Int. Cl.[5] ..... A45F 5/10; B65D 33/06

[52] U.S. Cl. ..... 294/171; 294/137

[58] Field of Search ..... 294/137, 153, 166, 170, 294/171; 16/114 R, 114 B; 220/94 R, 95, 96; 229/117.09, 117.19; 383/6, 13, 25

[56] References Cited

U.S. PATENT DOCUMENTS

| | | | |
|---|---|---|---|
| 645,317 | 3/1900 | Flanders | 294/170 |
| 645,670 | 3/1900 | Ottignon | 294/171 |
| 736,632 | 8/1903 | Priddat . | |
| 1,028,489 | 6/1912 | Priddat . | |
| 1,226,403 | 5/1917 | Snyder . | |
| 1,255,273 | 2/1918 | Anderson | 294/170 |
| 1,268,775 | 6/1918 | Stanger | 294/171 |
| 1,576,546 | 3/1926 | Ransom | 294/171 |
| 1,678,005 | 7/1928 | Hallerman . | |
| 2,394,050 | 2/1946 | Goza . | |
| 2,444,558 | 7/1948 | Elliott . | |
| 2,506,781 | 5/1950 | Elliott . | |
| 2,519,186 | 8/1950 | Herbert et al. | 294/171 X |
| 2,547,343 | 4/1951 | O'Loughlin . | |
| 2,717,411 | 9/1955 | Taipale . | |
| 2,821,739 | 2/1958 | Mohs . | |
| 3,072,955 | 1/1963 | Mitchell . | |
| 3,682,023 | 8/1972 | Green, Jr. . | |
| 3,912,140 | 10/1975 | Franges . | |
| 3,913,172 | 10/1975 | Richards et al. . | |
| 4,004,722 | 1/1977 | Olivier . | |
| 4,796,940 | 1/1989 | Rimland . | |
| 4,846,519 | 7/1989 | Leonard . | |
| 4,890,355 | 1/1990 | Schulten . | |
| 4,902,060 | 2/1990 | Nobakht . | |
| 4,923,235 | 5/1990 | Stewart . | |
| 4,946,065 | 8/1990 | Goulter et al. . | |
| 4,982,989 | 1/1991 | Sweeny | 294/171 |
| 5,005,891 | 4/1991 | Lunsford . | |

FOREIGN PATENT DOCUMENTS

| | | | |
|---|---|---|---|
| 193301 | 11/1957 | Austria | 294/171 |
| 85524 | 8/1983 | European Pat. Off. | 294/171 |
| 3509679 | 9/1986 | Fed. Rep. of Germany | 294/171 |
| 3641340 | 6/1988 | Fed. Rep. of Germany | 294/171 |
| 761947 | 11/1956 | United Kingdom | 294/171 |
| 2147800A | 5/1985 | United Kingdom . | |
| 2153213 | 8/1985 | United Kingdom | 294/171 |

*Primary Examiner*—Johnny D. Cherry
*Attorney, Agent, or Firm*—Dennis H. Lambert

[57] ABSTRACT

A hand grip device that is easily attached to and removed from the carrying handle of an article such as a plastic merchandise bag, bucket, pail or the like, to provide a relatively wide support surface for improved comfort to the hand of the user, and to prevent separation of the carrying handles of a plastic merchandise bag when the bag is set down. The device comprises a flexible, normally flat body that is easily stored and carried when not in use, and which may be folded about the carrying handle of an article and adjusted along the handle for proper balance. The hand grip device has a longitudinal slit formed in each end, terminating at an enlarged opening for receiving and retaining the carrying handle, and a plurality of flexible fingers or teeth are formed along the slit to facilitate application of the device to a handle, and to securely grip the handle when the device is released, as when the article is set down. In one form of the invention, the slits extend along a zig-zag path, defining a saw tooth configuration which defines the flexible fingers or teeth. In another form of the invention, the slits extend along a straight line and a plurality of transversely extending slits intersect the longitudinal slit to form the flexible fingers or teeth.

12 Claims, 5 Drawing Sheets

FIG. 9
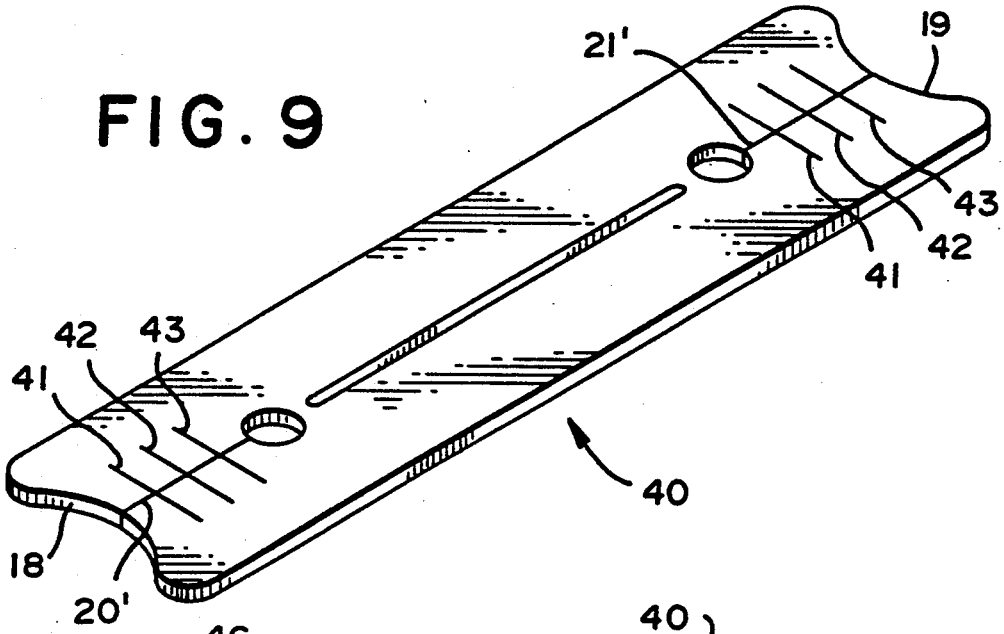
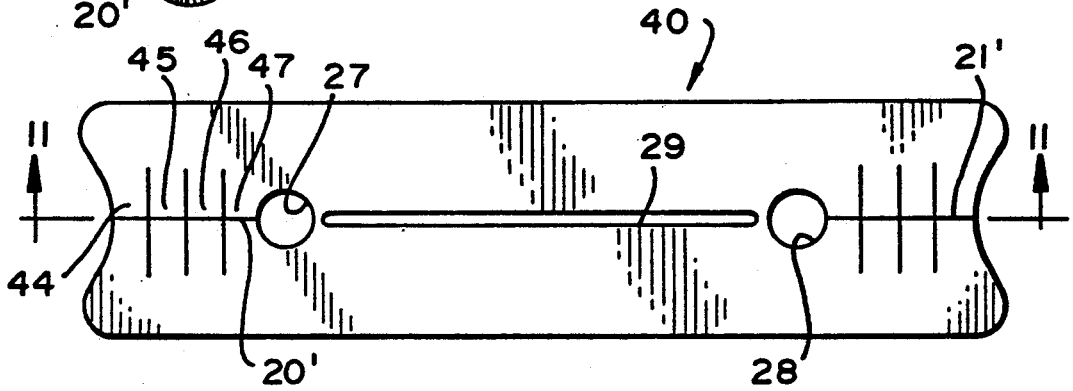
FIG. 10
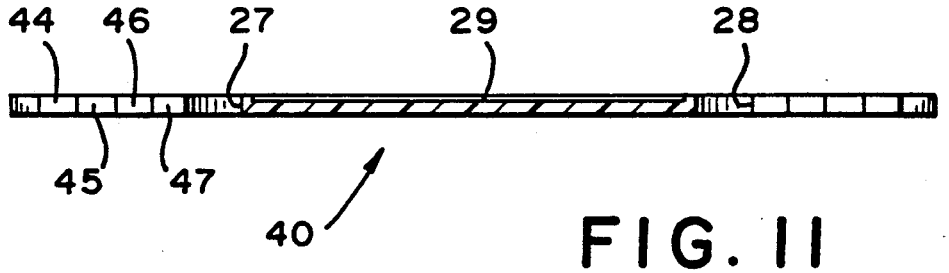
FIG. 11

DETACHABLE HAND GRIP FOR CARRYING BAGS AND THE LIKE

TECHNICAL FIELD

This invention relates to hand grips to facilitate the carrying of articles. More particularly, the invention relates to a detachable hand grip which may be placed in operative association with the handle of an article such as a bag, pail, or the like, to improve the comfort and ease of carrying the article. In particular, the invention relates to such a device which may be applied to the plastic carrying handles or loops on plastic merchandise bags to prevent opening of the bag when it is set down.

BACKGROUND ART

Many packages and articles that are in widespread use have carrying handles that present a small or narrow support surface to the hand of the person carrying them. For instance, paint cans or pails have a wire bail which is used to carry the can or pail, and the plastic merchandise bags which are used in virtually all grocery stores, as well as in other establishments, have plastic loops or carrying handles formed at an upper end of the bag. When the bag is filled with goods and carried by these handles, they bunch up and present a very small cross section to the hand of the person carrying the bag. The relatively small carrying handles on these articles are uncomfortable to the user. Nonetheless, the plastic merchandise bags are popular with merchandisers and consumers alike because of their versatility and strength. However, in addition to the complaint relating to the discomfort caused to the user by the relatively narrow supporting surface of the carrying handles provided on these articles, the carrying handles or loops provided on plastic merchandise bags also tend to separate when the bag is released by the person carrying it, whereby the top of the bag is liable to open, spilling the contents of the bag.

In order to alleviate these problems, various hand grip devices have been developed in the art for carrying packages or bags having rope or plastic handles, and cans or pails, such as paint cans, having wire bails. Such hand grip devices have also been developed for carrying plastic merchandise bags of the type commonly used in grocery stores and other merchandising outlets. In use, these hand grip devices are placed around the handles of the article to be carried so that they provide a larger supporting surface and thereby contribute to the comfort of the user.

Some of these prior art devices are rigid and are manufactured with a predetermined curvature or shape, while others are flexible and have fastening means built into them to maintain them in folded relationship about the carrying handle of the article on which they are used. Further, some of the rigid prior art devices have notches at opposite ends for receiving the carrying handle of the article to retain the hand grip in place.

These prior art devices are either relatively complex and expensive in construction, and/or require extra manipulative steps to place them on and remove them from the carrying handle of an article, and/or do not have any means for retaining the device in place on the carrying handle, and/or are relatively bulky and not easily carried or stored when not in use.

Accordingly, there is need for a hand grip device that may be easily placed on and removed from the carrying handle of an article, which is simple and inexpensive to manufacture, which may be easily carried or stored when not in use, and which retains the carrying handles especially of plastic merchandise bags in place to prevent spilling of the contents of the bag when the person carrying the bag sets it down.

DISCLOSURE OF THE INVENTION

It is an object of the present invention to provide a hand grip device which solves the problems and meets the objectives enumerated above.

A more specific object is to provide a flexible, normally flat hand grip device which is easily stored and which may be carried in a purse, wallet or pocket when not in use, but which may be folded about the carrying handle of an article to provide a relatively wider supporting surface for carrying the article.

Another object is to provide a hand grip device which may be easily attached to and removed from the carrying handle of a plastic merchandise bag, pail, or the like, and which includes means for retaining the hand grip device in place on the carrying handle when the article is set down by a person carrying it.

A further object is to provide a flexible, normally flat hand grip device which has a fold line along a central, elongate axis thereof, and which has notches at its opposite ends to receive and retain the carrying handle or handles of an article when the hand grip device is folded about the carrying handle or handles.

Yet another object is to provide a hand grip device which has means defining a plurality of flexible fingers or teeth at its opposite ends to facilitate placement of the device on the carrying handles of an article, and which also serve to securely retain the device in place.

To attain the foregoing objects, the present invention comprises a thin, flexible body which has a longitudinal slit at each of its opposite ends leading to notches or enlarged openings for receiving and retaining the carrying handles of an article, and wherein a plurality of flexible fingers or teeth extend along opposite sides of the longitudinal slits to facilitate placement of the hand grip device on a carrying handle, and which also serve to more securely retain it in place. The body is normally flat so that it can be easily stored and carried, and has a longitudinal fold line to facilitate its use. It is simple and inexpensive in construction and is easy to use.

In one form of the invention, the longitudinal slits each extend along a zig-zag path, which defines the plurality of flexible teeth or fingers.

In another form of the invention, the longitudinal slits extend along a straight line and a plurality of additional slits transversely intersect the longitudinal slits to define the flexible fingers or teeth.

BRIEF DESCRIPTION OF THE DRAWINGS

The invention will be more easily understood by reference to the following detailed description and accompanying drawings, wherein like reference characters designate like parts throughout the several views, and wherein:

FIG. 2 is a perspective view showing the invention being used with the carrying handles of a plastic merchandise bag of the type used to carry groceries and the like;

FIG. 9 is an enlarged perspective view of another form of the invention, wherein the longitudinal slits at opposite ends of the device extend along a straight path, and a plurality of transversely extending slits intersect the longitudinal slits to form the flexible fingers, with the device shown in its natural, unfolded state when not in use;

FIG. 10 is a top plan view of the hand grip device of FIG. 9;

FIG. 11 is a longitudinal sectional view of the modified hand grip device of FIG. 9, taken along line 11—11 in FIG. 10;

BEST MODE OF CARRYING OUT THE INVENTION

Figure 1:
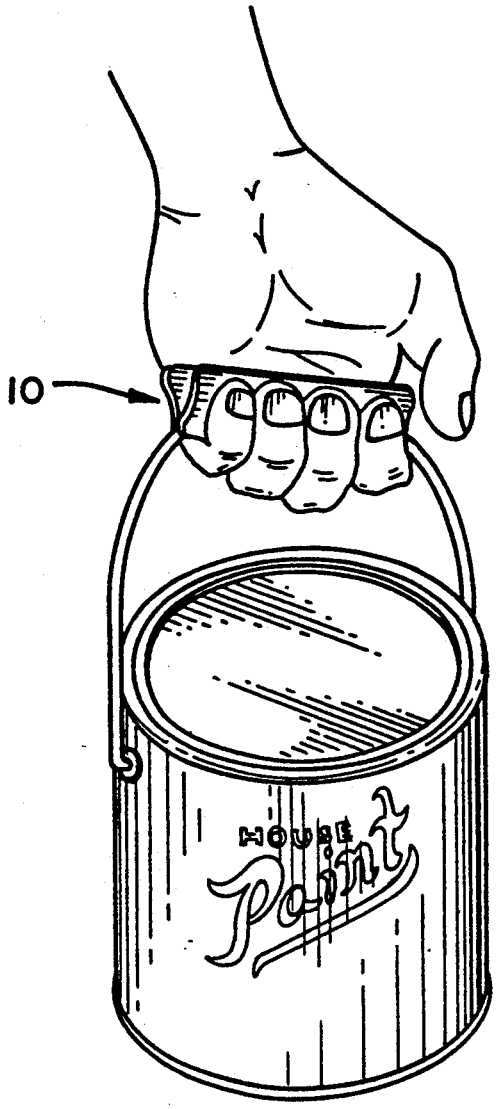
FIG. 1 is a perspective view showing the invention being used with the carrying handle or bail of a bucket or pail.
Figure 2:
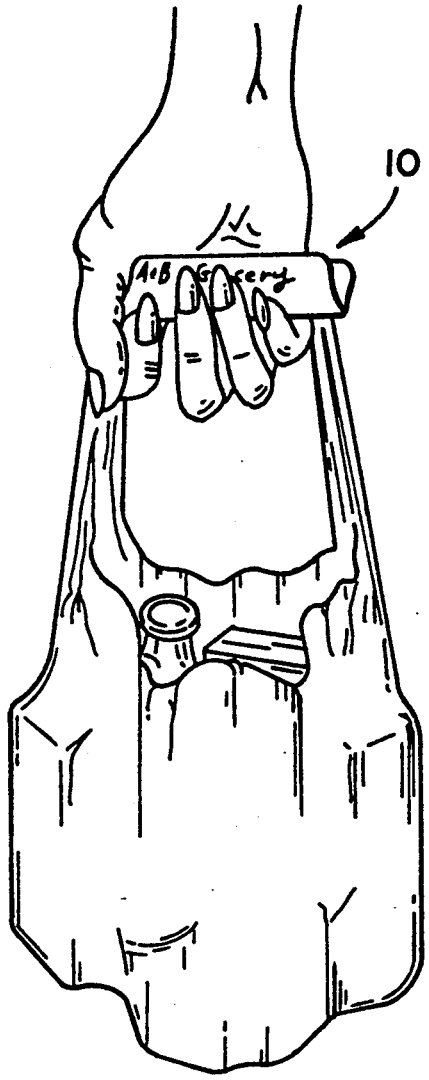

Referring more particularly to the drawings, the preferred form of hand grip device of the invention is indicated generally at 10 in FIGS. 1-8. The hand grip device 10 comprises a thin, flexible, normally flat, generally rectangularly shaped elongate body 11 having a top surface 12, a bottom surface 13, opposite ends 14 and 15, and Opposite side edges 16 and 17.

The opposite ends have a concave, V-shaped configuration 18 and 19 formed in them for guiding a carrying handle toward the longitudinal center line of the device. Longitudinal, zig-zag shaped slits 20 and 21 extend inwardly along the centerline of the body from the base of the V-shaped notches at the respective opposite ends of the device. These slits are normally essentially closed, as seen in the drawings, and are spread open when a carrying handle is forced inwardly along the slits by placing the device on the carrying handle and exerting a lifting force on it.

As seen, the zig-zag shaped slits 20 and 21 define a plurality of saw-tooth-shaped flexible teeth or fingers 22, 23, 24, 25 and 26 extending along opposite sides of the longitudinal slits. These multiple teeth, being individually smaller in cross section than the end portions of the body would otherwise be on opposite sides of the longitudinal slits, bend more readily and make it easier to slide a carrying handle through the longitudinal slits 20 and 21. They also more securely retain the carrying handle in place and prevent its inadvertent removal through the longitudinal slits.

The device normally lies flat, but is folded about the hinge line when placed in operative position about the handle of an article to be carried. When used on the plastic carrying handles of a plastic merchandise bag, for example, the handles slide into the notched ends of the device and along the longitudinal slits to the openings at the inner ends of the slits. When the device is released, it resumes its normally flat shape, so that the fingers or teeth formed along opposite sides of the longitudinal slits close against one another and grip the bunched plastic loop or handle.

Figure 3:
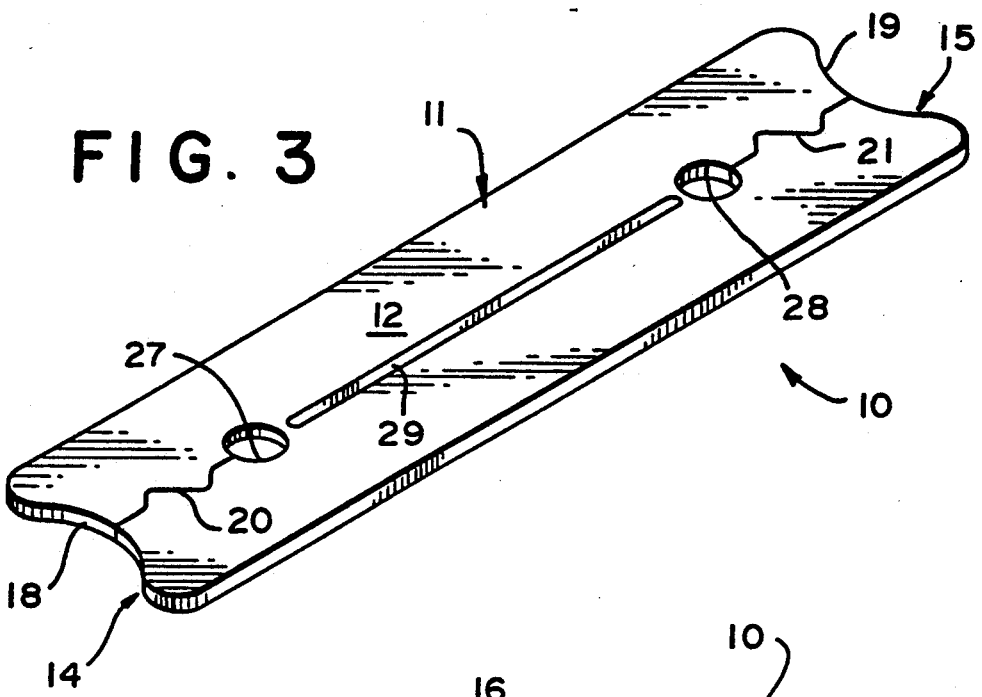
FIG. 3 is an enlarged perspective view of a preferred form of the invention, wherein the slits at opposite ends of the device extend along a zig-zag path, with the device shown in its natural, unfolded state when not in use.

When the device assumes its flat position, as shown in FIG. 3, for example, the teeth essentially close toward one another and will securely grip any carrying handle received in the device.

A pair of rounded or other suitably shaped openings 27 and 28 are formed through the body at the inner ends of the slits 20 and 21 for receiving the carrying handle or handles after they have traversed the length of the slits. These openings are sized so that the location of the device along the carrying handle may be adjusted for proper balance.

Figure 4:
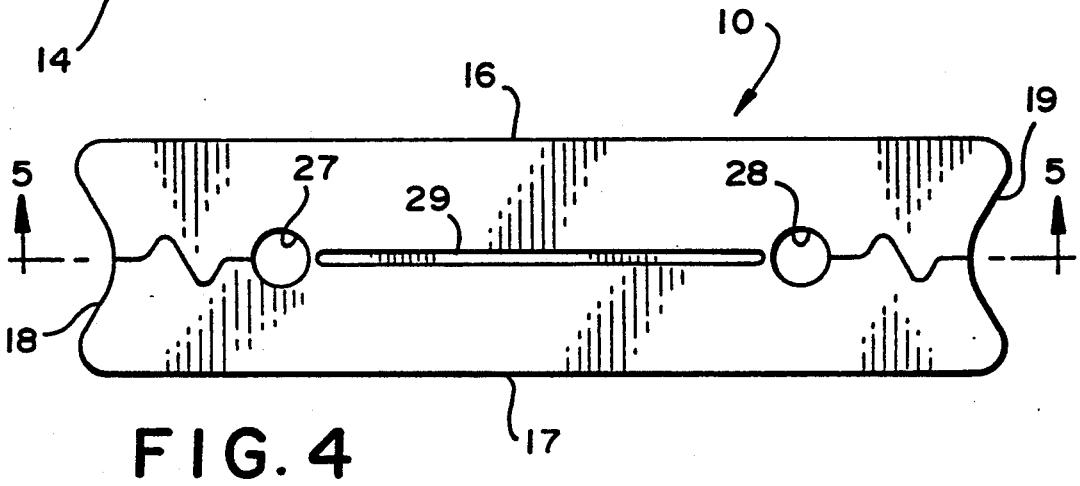
FIG. 4 is a top plan view of the hand grip device of FIG. 2.
Figure 5:
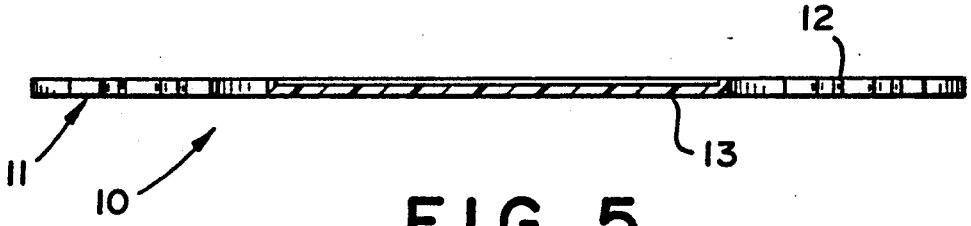
FIG. 5 is a longitudinal sectional view of the hand grip device, taken along line 5-5 in FIG. 4.
Figure 6:
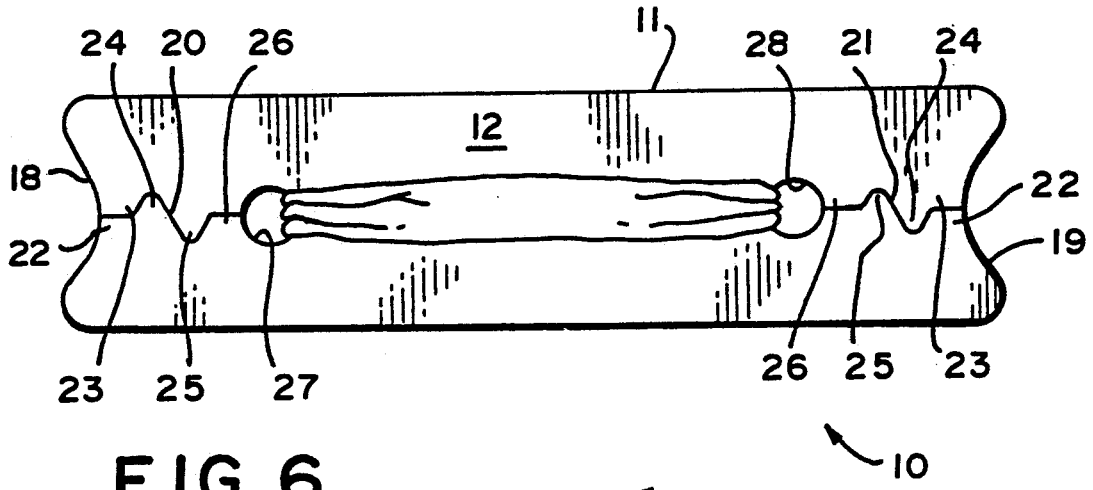
FIG. 6 is a top plan view of the hand grip device of the invention, with the plastic carrying handles of a plastic merchandise bag in place in the notches or openings in the device.
Figure 7:
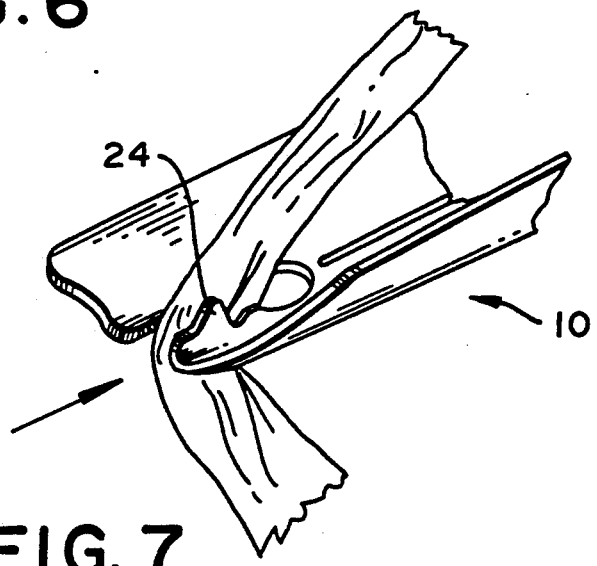
FIG. 7 is a fragmentary, perspective view of the hand grip device of the invention, showing how the flexible fingers bend to facilitate entry of the handles through the slits at the end of the device.
Figure 8:
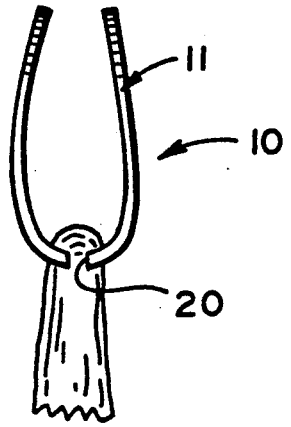
FIG. 8 is a fragmentary end view of the device, showing the relationship between the device and the plastic handles of a plastic merchandise bag.
Figure 12:
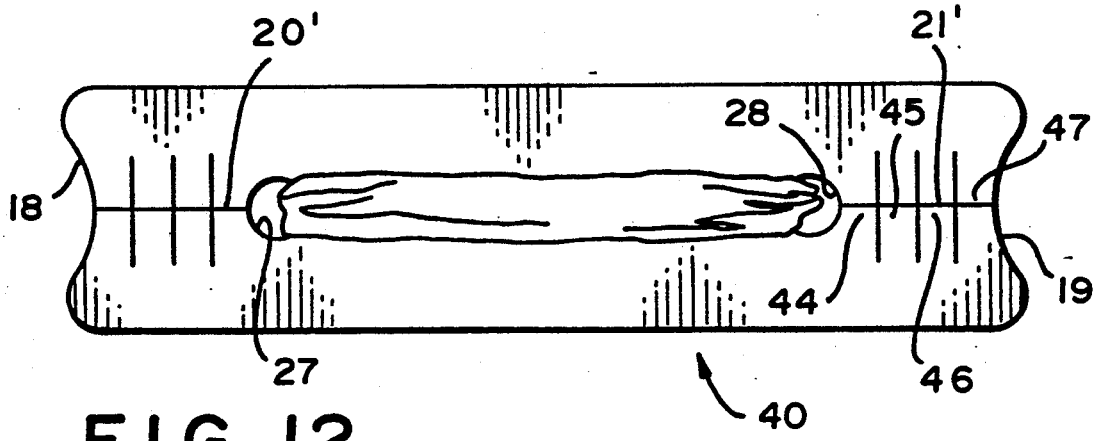
FIG. 12 is a top plan view of the hand grip device of FIG. 9, with the plastic carrying handles of a plastic merchandise bag in place in the notches or openings in the device.
Figure 13:
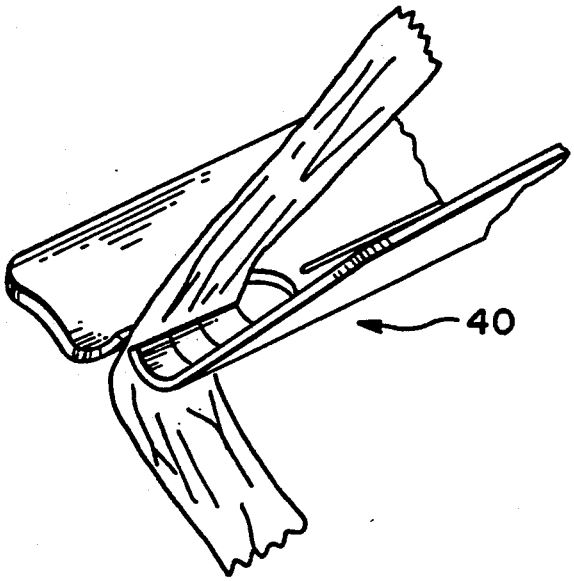
FIG. 13 is a fragmentary, perspective view of the modified hand grip device of the invention, showing how the flexible fingers bend to facilitate entry of the handles through the slits at the ends of the device.
Figure 14:
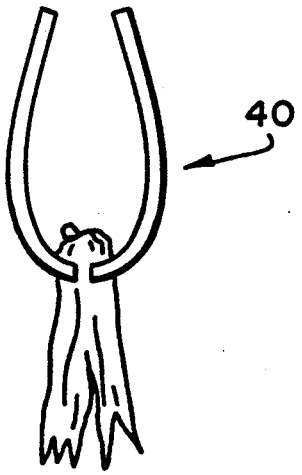
FIG. 14 is a fragmentary end view of the modified device, showing the relationship between the device and the plastic handles of a plastic merchandise bag.

As seen best in FIGS. 3, 4 and 5, a score line or hinge line 29 is formed along the longitudinal centerline of the device to facilitate folding of the device about the carrying handle or handles.

A second form of the invention is indicated generally at 40 in FIGS. 9-13. In this form of the invention, the longitudinal slits 20' and 21' extend along a straight path from the end of the body to the openings 27 and 28, and a plurality of transversely extending slits 41, 42 and 43 intersect the longitudinally extending slits 20' and 21' along their length, defining a plurality of flexible fingers or teeth 44, 45, 46 and 47 along opposite sides of the slits 20' and 21'. In all other respects, this form of the invention functions the same as previously described in connection with the preferred form of the invention.

A specific example of a hand grip device constructed in accordance with the invention is made of high density polyethylene and has a length of five inches, a width of one and a quarter inches, and a thickness of thirty-five thousandths of an inch.

While the invention has been illustrated and described in detail herein, it is to be understood that various modifications may be made therein without departing from the spirit and scope of the invention, as defined by the appended claims.

What is claimed is:

1. An easily attachable and detachable hand grip device for use on the carrying handles of articles, comprising:

a thin, flexible, normally flat, elongate body having opposite ends, opposite side edges and top and bottom surfaces, said body having a longitudinal centerline and being foldable along said centerline about the carrying handle of an article to provide a relatively wide, comfortable support surface for carrying the article, said hand grip device returning to its normally flat condition when it is released;

a longitudinal slit extending inwardly a short distance from each of said opposite ends along the longitudinal centerline of the body and terminating at an inner end in an enlarged opening which is adapted to receive and retain the carrying handle of an article on which said hand grip device is used; and means associated with each slit forming a plurality of flexible fingers extending along opposite sides of the slit and which flex and fold out of the way to permit passage therebetween of the carrying handle of an article to facilitate entry through the slit of the carrying handle and which close toward one another to assist in preventing inadvertent removal of the carrying handle through the slits when the hand grip device is released and returns to its normally flat condition.

2. A hand grip device as claimed in claim 1, wherein:

the longitudinal slits each extends along a zig-zag path, defining a saw tooth configuration, said saw tooth configuration comprising the means forming the plurality of flexible fingers along opposite sides of the slit.

3. A hand grip device as claimed in claim 2, wherein:

the opposite ends of the elongate body have a concave, V-shaped configuration defining guide surfaces for guiding a carrying handle toward the longitudinal centerline of the body and the longitudinal, zig-zag slits formed therein.

4. A hand grip device as claimed in claim 3, wherein:

a score line is formed along the longitudinal centerline in one of the top and bottom surfaces of the body to define a hinge line about which the body is folded when it is placed in operative association with the carrying handle of an article.

5. A hand grip device as claimed in claim 4, wherein:

the body is formed of a synthetic plastic material and is approximately five inches long, one and one-quarter inches wide, and thirty-five thousandths of an inch thick.

6. A hand grip device as claimed in claim 1, wherein:

the opposite ends of the elongate body have a concave, V-shaped configuration defining guide surfaces for guiding a carrying handle toward the longitudinal centerline of the body and the longitudinal slits formed therein.

7. A hand grip device as claimed in claim 6, wherein:

a score line is formed along the longitudinal centerline in one of the top and bottom surfaces of the body to define a hinge line about which the body is folded when it is placed in operative association with the carrying handle of an article.

8. A hand grip device as claimed in claim 1, wherein:

a score line is formed along the longitudinal centerline in one of the top and bottom surfaces of the body to define a hinge line about which the body is folded when it is placed in operative association with the carrying handle of an article.

9. A hand grip device as claimed in claim 1, wherein:

the longitudinal slit extends along a straight line, and the means forming the plurality of flexible fingers comprises a plurality of transversely extending slits intersecting the longitudinal slits in the opposite ends of the body.

10. A hand grip device as claimed in claim 9, wherein:

the opposite ends of the elongate body have a concave, V-shaped configuration defining guide surfaces for guiding a carrying handle toward the longitudinal centerline of the body and toward the transversely extending slits.

11. A hand grip device as claimed in claim 10, wherein:

a score line is formed along the longitudinal centerline in one of the top and bottom surfaces of the body to define a hinge line about which the body is folded when it is placed in operated association with the carrying handle of an article.

12. A hand grip device as claimed in claim 11, wherein:

the body is formed of a synthetic plastic material and is approximately five inches long, one and one-quarter inches wide, and thirty-five thousandths of an inch thick.

* * * * *